US005224866A

United States Patent [19]

Nakamura et al.

[11] Patent Number: 5,224,866

[45] Date of Patent: Jul. 6, 1993

[54] SURFACE MOUNT CONNECTOR

[75] Inventors: Tatsuya Nakamura, Hino; Shoji Kikuchi, Hiratsuka, both of Japan

[73] Assignee: AMP Incorporated, Harrisburg, Pa.

[21] Appl. No.: 823,028

[22] Filed: Jan. 16, 1992

Related U.S. Application Data

[63] Continuation of Ser. No. 675,839, Mar. 27, 1991, abandoned.

[30] Foreign Application Priority Data

Apr. 2, 1990 [JP] Japan ..... 2-034264
Jun. 11, 1990 [JP] Japan ..... 2-151810

[51] Int. Cl.[5] ..... H01R 9/09

[52] U.S. Cl. ..... 439/81; 439/842; 439/346; 439/676

[56] References Cited

U.S. PATENT DOCUMENTS 3,960,434 6/1976 Soes ..... 439/660
4,479,686 10/1984 Hoshino et al. ..... 439/78
4,734,060 3/1988 Kawawada et al. ..... 439/660
4,971,565 11/1990 Fox, Jr. ..... 439/660
5,030,107 7/1991 Moon ..... 439/78

FOREIGN PATENT DOCUMENTS 1268247 5/1968 Fed. Rep. of Germany ..... 439/660
424905 5/1967 Switzerland ..... 439/660

*Primary Examiner*—David Pirlot
*Attorney, Agent, or Firm*—Adrian J. LaRue; Timothy J. Aberle

[57] ABSTRACT

An electrical connector for electrically connecting circuit boards together comprising a plug connector (10,40) having plug contacts (13,43) secured in an insulating housing (**11*a*, 11*b*, 41*a*) at spaced intervals therealong; a receptacle connector (20,30,50,60) having receptacle contacts secured in an insulating housing (21,31,52*a*,62*a*) for electrical engagement with respective plug contacts (13,43) When the connectors are mated; the receptacle contacts and the plug contacts have interlocking sections (17,28,35,43*b*, 56*a*,66*a***) which are interlocked when the connectors are connected together thereby preventing their disengagement.

13 Claims, 4 Drawing Sheets

SURFACE MOUNT CONNECTOR

This application is a Continuation of Application Ser. No. 07/675,839 filed Mar. 27, 1991, now abandoned.

FIELD OF THE INVENTION

This surface mount connector relates to the improvement of miniature electrical connectors with a high density of contacts used for the connection of printed circuit boards of small electronic devices of home appliances and other electronic equipment.

This invention therefore relates to surface mount connectors comprising a plug and a receptacle, and especially to an improved miniature connector with densely-arranged contacts.

BACKGROUND OF THE INVENTION

The reduction in size of electronic devices and the improvement of their performance is accompanied by the reduction in size of the electronic components and structural parts and by an increase in their density. Electrical connectors are not an exception from this trend; there is a demand for electrical connectors with multiple contacts arranged in high density, for example, at a pitch of 0.5 mm. Such miniature high-density connectors are used as surface mount (SMT) components, and since, due to the small size of their terminals and narrow spacing separating them, they are not suitable for conventional methods of soldering; the so-called reflow soldering method is used for their mounting.

In recent years, due to the proliferation of such electronic appliances as video cameras, the demand has grown for miniature connectors for connecting PC boards and units. There is a particularly strong demand for surface mount connectors, which greatly facilitate electrical connections and make it possible to increase the density of electronic components. Such surface mount connectors usually include a receptacle-type connector soldered to a PC board and a plug-type connector soldered to another PC board which is to be connected to the former one. When these connectors are plugged together, their mating electrical contacts are electrically engaged thereby forming an electrical connection between the components of these PC boards. The connectors are usually equipped with locking devices located either on their outside or inside walls to prevent accidental disengagement.

However, using such locking devices either on the outside or inside of the connectors results in a more complicated structure and larger sizes, which prevents further increase in the mounting density on the boards. Therefore, attempts have been made to dispense with such devices, using instead the force of friction between the matching contacts of the plug-type and receptacle-type connectors in an engaged state (see patent Publication 88-285880).

These SMT connectors are known in the art. For example, the SMK Company of Japan markets the PB-10 connector with a 1 mm pitch for the connection of 2 parallel PC boards. However, since the contacts of this connector's plug are exposed, there is the danger of a short circuit if a conductive element comes into contact with the exposed contacts. This problem becomes even more acute if the pitch is reduced to 0.5 mm. In addition, it is impossible to provide a sufficiently large device locking the plug and receptacle in a connected position; as a result, the reliability of the connection deteriorates with repetitive plugging and unplugging of the connector. Besides, in the case of small-size electronic devices, the relatively small PC boards often must be connected not only parallel to each other, but also perpendicularly. Designing individual connectors for each specific application is far from economical.

Therefore, a new miniature surface mount connector is provided with high-density contacts (of the order of 0.5 mm) which can withstand frequent plugging and unplugging, and is suitable for connection of PC boards in a horizontal as well as a vertical position without substitution of at least one component.

SUMMARY OF THE INVENTION

In accordance with the present invention, a surface mount connector comprises a plug-type connector including a long and narrow insulating housing with a cross section in the shape of an ink bottle having a number of contacts arranged in two rows inserted and secured in lateral surfaces of the lower parts of the housing, so as to be soldered to a first printed circuit board (PCB); a receptacle-type connector, which is shaped as a trough, matching the plug-type connect or, is soldered to a second PCB which can be placed either in a parallel or a perpendicular position to the first PCB. The receptacle-type connector has a number of contacts on both sides of the trough. When the plug and receptacle connectors are connected, the protrusions of the plug contacts become engaged with the matching recesses of the receptacle contacts and are retained in this position.

However, it is difficult to insure a reliable connection if only the force of friction between the contacts is being used without having recourse to locking devices. In addition, the workers who assemble such units do not have the feeling of a positive connection being made, such as in the case of an audible click. The purpose of this invention is to eliminate the above shortcomings without compromising the density of electronic components, and to provide a surface mount connector with a reliable connection which can be easily detected by workers assembling these units.

The surface mount connector, in accordance with this invention is characterized by the fact that it comprises a plug-type connector with a number of J-shaped contacts bent at their front ends, and of a receptacle-type connector in the form of a trough, into which the above mentioned plug-type connector can be inserted, having a number of contacts arranged on the inside walls thereof matching the locations of the contacts of the above plug-type connector; the contacts of the above plug-type connector have a locking section located at their front ends, and the contacts of the above receptacle-type connectors have a locking section for resilient engagement with the locking section of the above plug-type connector contacts when the connectors are joined together, thus preventing their disengagement.

The expression "front end" used in the above description stands for the direction in which the plug-type connector is inserted into the receptacle-type connector.

Based on the connector described above, it is possible to reliably prevent the accidental disengagement of the connectors without using locking devices on either the external or the internal walls of the connectors, that is without an increase in their size or without making the design more complicated, thus avoiding compromise of the mounting density of the electronic components on PC boards, due to the fact that the contacts of both connectors are equipped with locking sections which mutually engage when the connectors are plugged together. In addition, when the plug-type connector is inserted into the receptacle-type connector, the mutual engagement of the locking sections triggers a clicking sound, which signals the workers assembling PC boards that a proper connection has been made.

BRIEF DESCRIPTION OF THE DRAWINGS

The invention, together with objects and advantages thereof is best understood by way of example with reference to the following detailed description in conjunction with accompanying drawings.

DETAILED DESCRIPTION OF THE INVENTION

Figure 1:
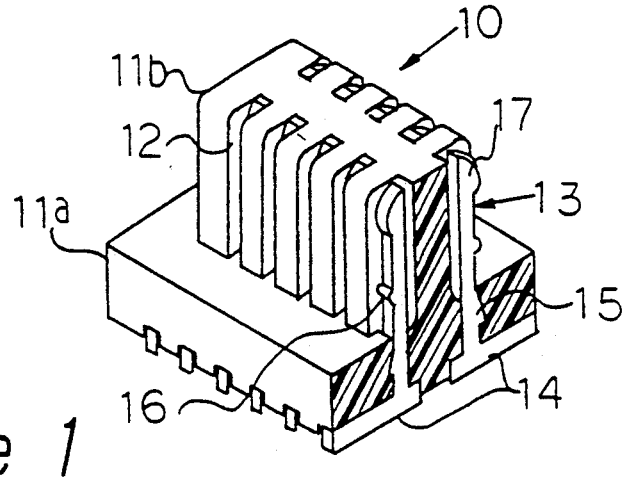
FIG. 1 is a perspective view of an embodiment of the plug-type connector used in surface mount connectors.
Figure 2:
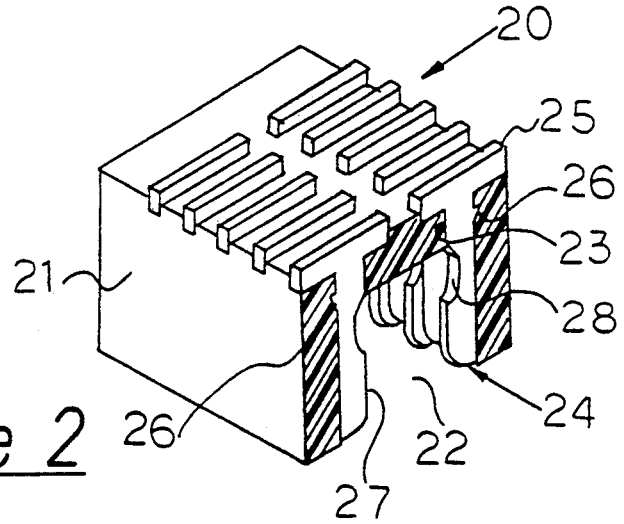
FIGS. 2 and 3 are perspective views of embodiments of receptacle-type connectors used with the connector shown in FIG. 1.
Figure 3:
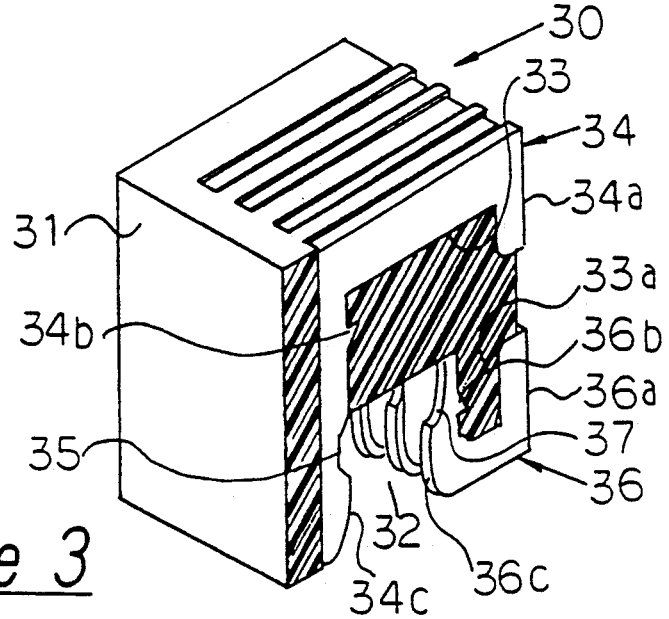

FIG. 1 shows a plug-type connector 10 of a suitable embodiment of a surface mount connector in accordance with this invention. FIGS. 2 and 3 represent receptacles 20 and 30 of a suitable embodiment for matable engagement with the plug shown in FIG. 1; the receptacle 20 is designed for a horizontal or parallel, and receptacle 30 for a vertical or perpendicular arrangement.

As can be seen from FIG. 1, the plug 10 has a housing 11 made of an insulating material having a flat base 11*a* and a protrusion 11*b*. On both sides of the protrusion 11*b* of the housing 11, there are cavities 12 for the contacts 13, which are arranged in two rows and extend through the base 11*a* to the bottom surface of the plug. Inside each cavity 12, there are contacts 13, preferably stamped from sheet metal, inserted from the bottom of the base 11*a* and fixed in this position. Each contact 13 has a portion 14 for surface mounting (or for soldering) slightly protruding from the base 11*a* of the insulating housing 11, a barb 15 which digs into the inside wall of the base 11*a* of the insulating housing 11, a contacting projection 16 and a front projection 17. All the parts of these contacts 13, with the exception of the portions designed for surface mounting to a PCB, are recessed below the surface of the insulating housing 11, thus eliminating the danger of an accidental shorting of the contacts by a conducting foreign body. Moreover, the insulating housing 11 can be made as long as needed to accommodate the required number of contacts 13; in FIG. 1, the connector is only partially shown.

Next, the embodiment of a horizontal receptacle-type connector 20 as shown in FIG. 2 is described. This receptacle-type connector 20 has a U-shaped trough 22 required for the acceptance of the narrow portion of the plug-type connector 10 shown in FIG. 1. The trough is made in a rectangular insulating housing 21. The insulating housing 21 has two rows of openings 23 made at the top of the housing into which contacts 24 for surface mounting are inserted and fixed along the inside walls of the U-shaped trough. The contacts 24 are preferably manufactured by stamping from a metal sheet. Each contact 24 has a portion 25 for surface mounting to a PCB slightly protruding above the top surface of the insulating housing 21, a barb 26 which digs into the side wall of the opening 23, as well as a straight contacting surface 27 and a C-shaped retaining recess 28.

Next follows the embodiment of a vertical plug-type connector 30 as shown in FIG. 3. This receptacle-type connector 30 also has a long narrow insulating housing 31 with a trough 32 similar to that shown in FIG. 2. This insulating housing 31 has openings 33 made along the top surface of the housing and along one side of the trough 32. Inside these openings 33, large U-shaped contacts 34 are inserted from the top and fixed therein. These contacts 34 have on the one side a connecting portion 34*a* for surface mounting, and on the other side, a barb 34*b*, a contacting portion 34*c* and a retaining recess 35. From the opposite side of the insulating housing 31, smaller U-shaped contacts 36 are inserted from the bottom and fixed to the recesses provided for this purpose in the wall 33*a*. These contacts 36 have connecting portion 36*a* for the surface mounting corresponding to the connecting portion 34*a* of the contacts 34, a barb 36*b*, a contact portion 36*c* and the retaining recess 37.

Figure 4:
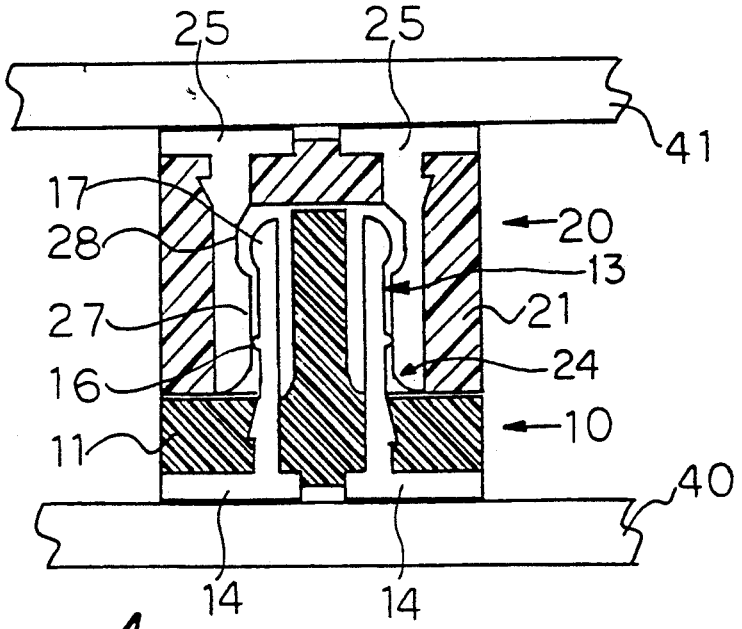
FIGS. 4 and 5 show respectively a cross section of the plug-type connector shown in FIG. 1 and the receptacle-type connector shown in FIG. 2 in a connected state used for a parallel connection of PC boards, and a cross section of the plug-type connector shown in FIG. 1 and the receptacle-type connector shown in FIG. 3 in a connected state used for a perpendicular connection of PC boards.
Figure 5:
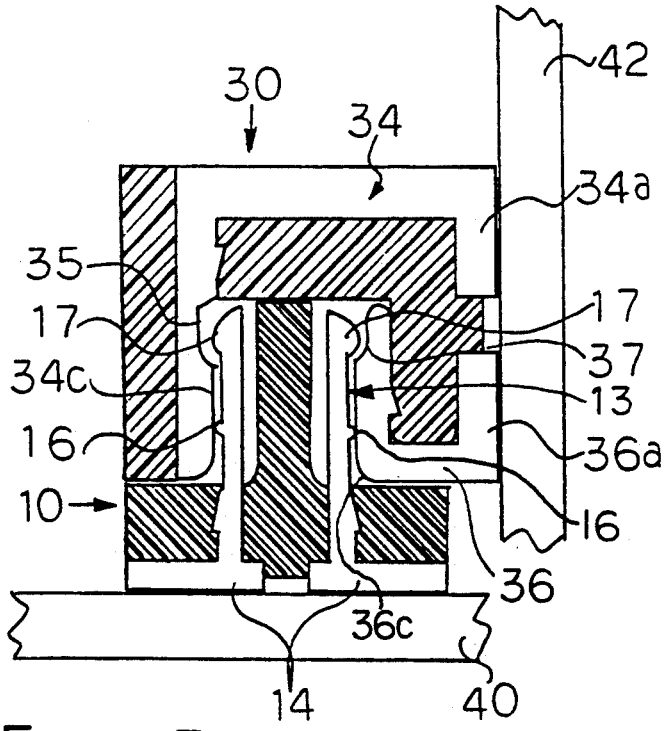

The operation of the connectors in accordance with this invention is explained below as seen in FIGS. 4 and 5.

In FIG. 4, there is shown a cross section of a plug-type connector 10 (shown in FIG. 1) and a receptacle-type connector 20 (shown in FIG. 2) used for connecting two parallel PCBs 40 and 41, for example to interconnect the conductors thereon (not shown). As can be seen from FIG. 4, the contacting portions 14 of the contacts 13 of the plug-type connector 10 are in contact with the surface conductors of the first PCB 40; the contacting portions 25 of the contacts 24 of the receptacle-type connector are in contact with the surface conductors of the second PCB 41. The front end projection 17 of the contact 13 of the plug-type connector 10 is interlocked with the recess section 28 of the contact 24 of the receptacle-type connector 20, thus holding connectors 10 and 20 together. In addition, the contacting projection 16 of the contact 13 comes in contact with the contacting surface 27 of the contact 24, thus forming an electrical connection between the contacts 13 and 24 of the connectors 10 and 20 respectively, and therefore between PCBs 40 and 41.

The contact 24 is fixed against the inside wall of the trough 22 of the insulating housing 21, while the mating contact 13, due to the fact that there is some space left between it and the wall, can resiliently bend to the left and to the right in the position shown in the drawing. When connectors 10 and 20 are joined together, the front projection 17 of the contact 13 "wipes" the contacting surface 27 of the contact 24, cleaning it of the oxide film and other foreign substances, thus creating conditions for a positive electrical engagement between the contacting projection 16 and contacting surface 27. Since the connectors 10 and 20 have a number of contacts 13 and 24, the connection of PCBs 40 and 41 presents sufficient mechanical strength to obviate the need for additional elements. The mechanical strength of the connection does not decrease after repeated pluggings and unpluggings. This eliminates the need to provide special elements on the insulating housings for locking the connectors 10 and 20 in place. Due to the small size of the connectors, a number of them may be used on the same board. Specifically, the connectors 10 and 20 described above are 3.5 mm high and 3.0 mm wide in their plugged-together position.

Next, the operation of a vertical-type connector (see FIG. 5) is analyzed. FIG. 5 shows a cross section of a plug-type connector 10 shown in FIG. 1 and a receptacle-type connector 30 shown in FIG. 3 used for connecting two perpendicular PCBs 40 and 42, for example to interconnect the conductors thereon (not shown).

The mutual position of the plug-type connector 10 and the first PCB 40 is the same as that shown in FIG. 4. The contacting portions 34*a* and 36*a* of the contacts 34 and 36 of the receptacle-type connector 30 are in contact with the conductors of the second PCB 42. When the connectors 10 and 30 are plugged, the contacting projection 16 of the left-side contact 13 of the connector 10 is in contact with the contacting surface 34*c* of the contact 34, and the projection 17 is interlocked with the recess 35. Similarly, the contact projection 16 of the right-side contact 13 is in contact with the contacting surface 36*c* of the contact 36, and the projection 17 is interlocked with the recess 37 of the contact 36.

In this case also, the interlocking of the projections and recesses of the contacts 13, 34 and 36 of the connectors 10 and 30 creates a reliable connection, and the wiping action of the projection 17 provides for a reliable electrical engagement with the contacting surfaces 34*c* and 36*c*, as it has been explained in the example of FIG. 4. These connectors are also very small; connectors 10 and 30 plugged together are 4 mm high and 3.5 mm wide.

Figure 6:
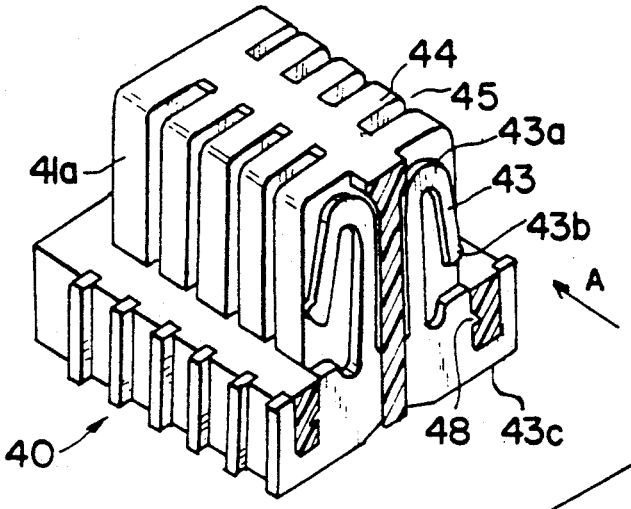
FIG. 6 is a perspective view of another embodiment of this invention, i.e. a plug-type connector used in surface mount connectors.
Figure 7:
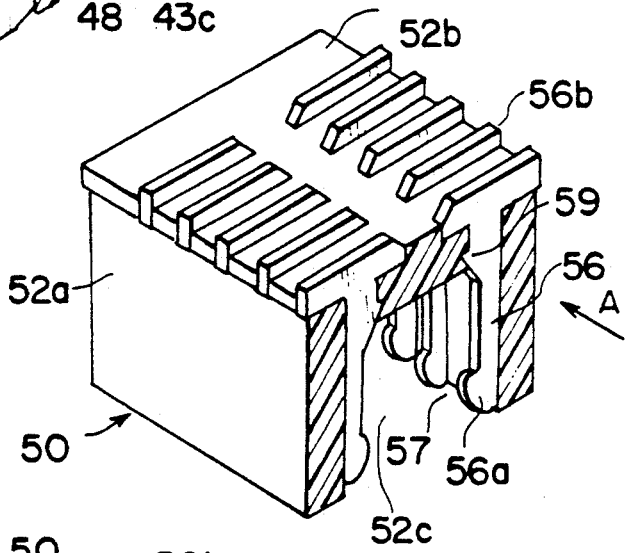
FIG. 7 is a perspective view of a first type of a receptacle-type connector in accordance with this invention used in surface mount connectors.

The plug-type connector 40 of another embodiment of a surface mount connector in accordance with this invention is shown in FIG. 6 and the matable receptacle-type connector 50 is shown in FIG. 7. When the plug-type connector 40 is inserted into the receptacle-type connector 50, together they form a surface mount connector. The plug-type connector 40 includes an insulating housing 41*a* with a cross section in the shape of an ink bottle having slots 45 in the housing walls 44 in a certain arrangement, into which J-shaped contacts 43 are inserted. These contacts 43 are made of a copper alloy or other electrically conductive material, and have a bent portion 43*a* at their front end (in the direction of the insertion into the receptacle-type connector 50) and are arranged at a 0.5 mm pitch. The bent portion is resilient, and when a compression force is applied to it in the direction facing the slot 45 (horizontally toward the housing 41*a*), the bent portion 43*a* generates a reaction in an opposite direction. In addition, a lug 43*b* is located at the tip of the bent portion 43*a*. The base 43*c* of the contact 43 protrudes from the bottom of the housing 41*a* to a predetermined distance and is intended for the soldering to a PC board. The contacts 43 are entirely within in the slots 45, and cannot touch each other. Each contact 43 has a barb 48 at its base which makes possible the securing of the contact 43 to the housing 41*a*.

Figure 8:
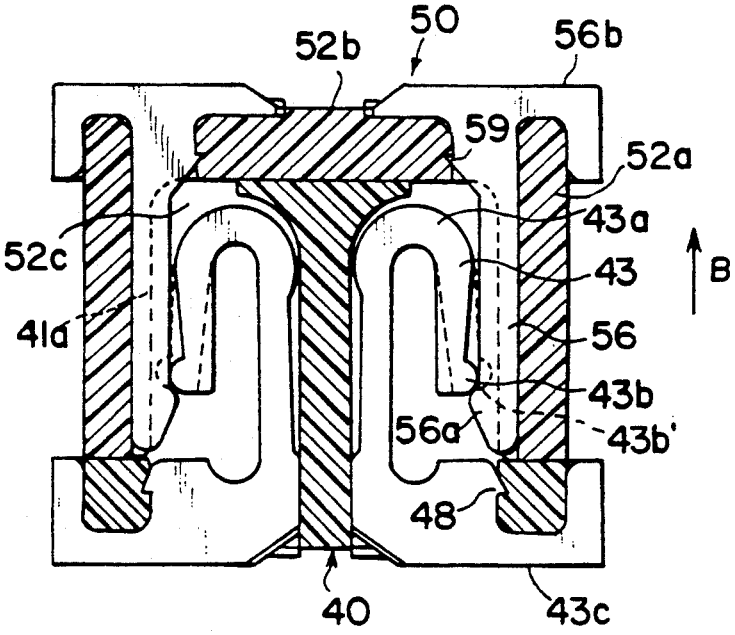
FIG. 8 is a cross section of the connectors shown in FIGS. 6 and 7 in an engaged state.

The receptacle-type connector 50, as can be seen from FIG. 7, includes an insulating housing 52*a* and contacts 56. These contacts, like the contacts 43, are made of a copper alloy or other conductive material, and are arranged at a 0.5 mm pitch between spacers 57. At the tips of these contacts there are lugs 56*a* facing the inside of the housing, which electrically engage with the lugs 43*b* of the plug-type connector 40 when the latter is inserted into the receptacle-type connector 50. A barb 59 is provided near the base 56*b* of the contacts 56 for securing the contacts 56 to the housing 52*a*. The contacts 56 are made in such a manner that their bases 56*b* extend upwards and above the upper surface 52*b* of the housing 52*a* a certain distance. This arrangement makes it easy to connect the receptacle type connectors 50 to a PC board by soldering the bases 56*b* of the contacts 56 to the conductors on the boards. FIG. 8 is a cross section of the above connectors 40 and 50 in a plugged state (as seen in the direction of the arrow A in FIGS. 6 and 7).

Thus, when the plug-type connector 40 is inserted (with the bent portions 43*a* of the contacts 43 first) in the direction of arrow B and into the trough 52*c* of the receptacle-type connector 50, the lugs 43*b* of the contacts 43 electrically engage the lugs 56*a*; when the plug-type connector 40 is inserted a little bit further, the lugs 43*b*, because of their resiliency, will be moved inwardly, and, upon further movement, they slip by the lugs 56*a* and assume the position shown in FIG. 8. At this time, the lugs 43*b*, due to the reaction forces generated by the shape of the contacts 43 spring back in the outward direction, but do not reach as far deep as their unloaded state 43*b*' (indicated by the broken line) because of the presence of the contact 56. Therefore, when the two connectors 40 and 50 assume this position, lugs 43*b* and 56*a* of the contacts 43 and 56 become electrically engaged, and they not only lock connectors 40 and 50 together, but also indicate to the worker that the electrical connection is completed.

Figure 9:
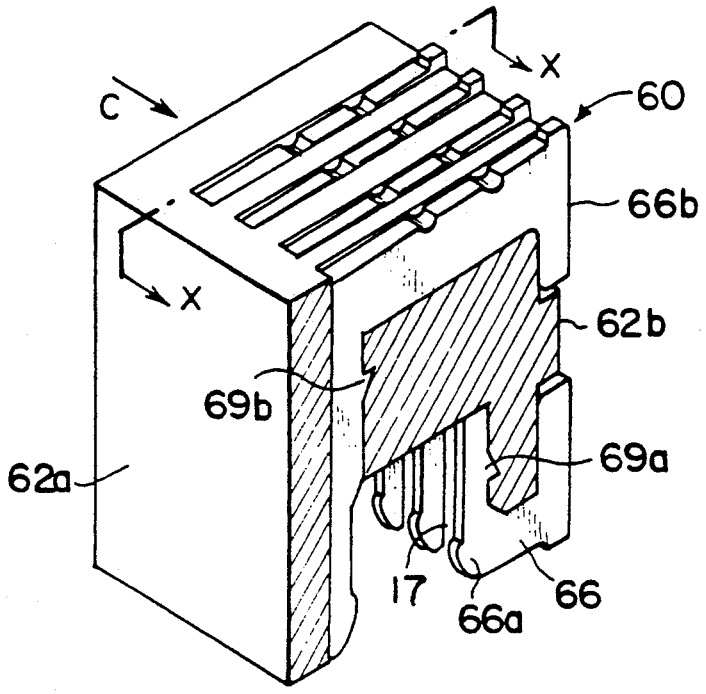
FIG. 9 is a perspective view of the second type of receptacle-type connector in accordance with this invention used in surface mount connectors.
Figure 10:
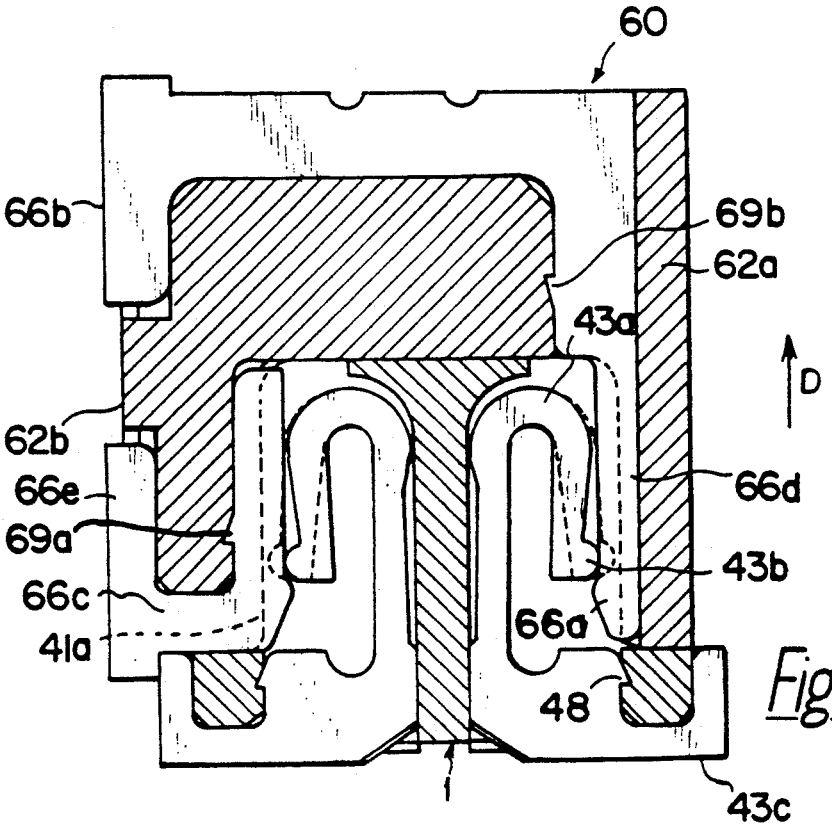
FIG. 10 is a cross section along line X—X of the connector shown in FIG. 9 and the connector shown in FIG. 1 in an engaged state.

FIG. 9 shows a further embodiment, different from the one shown in FIG. 7; FIG. 9 represents a cross section along line X—X as viewed in the direction of the arrow C of the receptacle-type connector 60 shown in FIG. 10 electrically connected with the inserted plug-type connector 40 shown in FIG. 6. The connector 60 shown in FIG. 9 is basically of the same design as the connector 50 shown in FIG. 7. The bases 66*b* and 66*e* of the contacts 66 extending from the lateral surface 62*b* serve to attach the connector to PC boards by means of soldering. This structure is convenient for the insertion of a plug-type connector in the direction parallel to the PC board. The contacts 66 arranged inside the housing 62*a* of the connector 60 are different from those used in the connector 50 shown in FIG. 7 in that the right and left contacts 66*c* and 66*d* have different shapes. On the other hand, these contacts 66 are similar to those of the connector 50 shown in FIG. 7 in the sense that they have barbs 69*a* and 69*b* for securing the contacts to the housing 62*a*. Therefore, the same plug-type connector 40 may be used in conjunction with two variations of the receptacle-type connector, 50 and 60.

Surface mount connectors in accordance with this invention are not limited to the embodiments described above and may include various modifications. For example, the contacts should not necessarily be arranged in two rows, but can be lined up on one side only. The locking lugs can be provided on one set of contacts with only a matching recess on the other set.

Since, as was explained above, the locking action of the contacts according to the configuration described above results in a positive connection of the plug-type and receptacle-type connectors in accordance with this invention, the use of such connectors makes it possible to reliably prevent disengagement of the connectors without compromising the increase in the assembly density. In addition, the clicking sound produced at the time of complete engagement helps to assure the quality of the connections.

Surface mount connectors, in accordance with this invention based on specific embodiments have been described. However, this invention is not limited to the analyzed embodiments; it also covers their various modifications. For example, the contacts 13 in two parallel rows may be shifted at half a pitch to a zig-zag arrangement. The contact 13 can be provided with two or several contacting projections 16, etc.

As can be seen from the above, the surface mount connectors in accordance with this invention have an extremely high density of contacts (0.5 mm) and a very small size, of the order of 3 mm. The projections at the front ends of the contacts of the plug-type connectors clean the contacting surface of the mating contacts and provide interlocking action with the recesses, thereby eliminating the need for special locking devices on the insulating housings. Moveover, since the contacts are positively fixed in place by means of barbs, their contacting portions are always in the same plane, thus facilitating soldering to the PC boards. The chance of accidental shorting is also eliminated, because the contacts of the plug-type connector do not protrude beyond the surface of the insulating housing. The connectors in accordance with this invention can be used either for parallel or perpendicular connections; however, the plug-type connector is common for both types of connections.

We claim:

1. An electrical connector for use in surface mounting on circuit boards requiring a fine pitch for board interconnections including plug and receptacle connector halves of profiles to allow the plug half to be inserted into and seated within the receptacle half, each half including a plastic housing of a given length and a given cross-sectional profile having an array of cavities in side-by-side relationship with each cavity substantially wider in a plane transverse to the given length of the housing than in a plane parallel to the given length of the housing to define closely spaced interior side surfaces, a contact in each cavity stamped of thin sheet metal to include sides and edges with the sides of substantially greater width dimension than the edges to minimize contact edge width and with the contacts fitted into said cavities on edge with the sides thereof supported by the cavity side surfaces to provide spring action in at least the plug half contacts in the plane of metal, each plug contact having a lug projection on the edge surface proximate the end thereof and each receptacle contact having a recess on the edge surface thereof positioned in the receptacle housing half so as to engage the lug projection upon said plug half being inserted and seated within the receptacle half to interlock the halves together against disengagement and each said contact further including a leg extending slightly beyond the cross-sectional profile of the housing with the edges of adjacent contacts in a parallel plane suitable for supporting the connector for surface mounting on a circuit board while being soldered thereto.

2. The connector of claim 1 wherein each said contact leg extending slightly beyond the edge surface of said housing is of a length substantially greater than the width of said edge to define a relatively broad area for connector support and soldering to the surface of a circuit.

3. The connector of claim 1 wherein the contacts are arranged in pairs along the length of the connector with the legs of adjacent contacts providing stable mounting of the said connector on the surface of a circuit for surface mounting and soldering.

4. The connector of claim 1 wherein the said lug projection is positioned to wipe the edge of the receptacle contact during insertion and mating of the plug half within the receptacle half and the said plug contact includes a further contact point spaced from the said lug projection to engage the receptacle contact and form an interconnection in an area wiped by the said lug.

5. The connector of claim 1 wherein the said cross-sectional profile of the housing of the plug half of the connector extends beyond the edge of the contacts thereof on the intermating face of the plug half to preclude shorting out of contacts by extraneous material engaging such face of the connector.

6. The connector of claim 1 wherein the said contact of the plug half includes a J configuration with the said contact point residing at the end of the said J profile to provide an elastic deflection driving the said edge of the plug half contact against the edge of the receptacle half contact.

7. The connector of claim 1 wherein the said plug and receptacle halves each include a pair of cavities residing in the same plane along the length of the said housing with the contacts therein forming rows of contacts parallel to each other.

8. The connector of claim 1 wherein each of the said contacts of the said receptacle includes a U-shaped profile with the contact point of the receptacle half residing within the given profile of the said housing and with a portion of the U forming the said leg extending beyond such profile to define an edge suitable for soldering to a circuit board.

9. An electrical connector for electrically connecting circuit boards together comprising a plug connector having an insulating housing in which electrical plug contacts are secured at spaced intervals along the housing; a receptacle connector having an insulating housing in which electrical receptacle contacts are secured at spaced intervals along the housing for electrical engagement with respective electrical plug contacts when the connectors are mated, the receptacle insulating housing has a U-shaped trough, each of said receptacle contacts having an electrical contact section extending along a surface of said U-shaped trough and a termination section extending outwardly from an outside surface of the receptacle insulating housing for electrical connection to a circuit board, the plug insulating housing has a protrusion; each of said plug contacts having an electrical contact portion extending along a side of said protrusion and a termination portion extending outwardly from an outside surface of the plug insulating housing for electrical connection to another circuit board, wherein one of said receptacle contact section and said plug contact is an overall rigidly fixed member thereby incurring no deflection upon mating of said receptacle and plug contacts and the other of said receptacle contact section and said plug contact portion comprises a resilient means for bending action in response to pressing engagement with said fixed member, the receptacle contacts and the plug contacts further include interengaging sections which are interengaged when said protrusion is positioned within said U-shaped trough when the connectors are mated thereby resisting disengagement of the contacts.

10. An electrical connector as claimed in claim 9, characterized in that the receptacle contacts have recesses therein for interengagably receiving projections at outer ends of the plug contacts.

11. An electrical connector as claimed in claim 9, characterized in that the receptacle contacts have lugs for interengagably engaging lugs at free ends of the plug contacts.

12. An electrical connector as claimed in claim 9 characterized in that said protrusion has slots in which said plug contact portions are disposed and along which said receptacle contact sections extend when said plug contact portions and said receptacle contact sections are electrically connected together.

13. An electrical connector as claimed in claim 9, characterized in that said receptacle termination sections and said plug termination portions define surface mounting termination members for electrical connection to electrical conductors on the circuit boards.

* * * * *